US007445323B2

(12) United States Patent
Anderson, Jr. et al.

(10) Patent No.: US 7,445,323 B2
(45) Date of Patent: Nov. 4, 2008

(54) INK CARTRIDGE VENTING

(75) Inventors: James Daniel Anderson, Jr., Harrodsburg, KY (US); Trevor Daniel Gray, Midway, KY (US); David Emerson Greer, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 496 days.

(21) Appl. No.: 11/314,296

(22) Filed: Dec. 21, 2005

(65) Prior Publication Data

US 2007/0139492 A1 Jun. 21, 2007

(51) Int. Cl.
*B41J 2/175* (2006.01)

(52) U.S. Cl. ..... 347/86; 347/85

(58) Field of Classification Search ..... 347/84–87
See application file for complete search history.

(56) References Cited

U.S. PATENT DOCUMENTS

| | | | | |
|---|---|---|---|---|
| 4,806,032 | A | 2/1989 | Gragg et al. | |
| 5,642,144 | A | 6/1997 | Plotkin | |
| 6,145,974 | A | 11/2000 | Shinanda et al. | |
| 6,238,042 | B1 * | 5/2001 | Kobayashi et al. | 347/86 |
| 6,247,804 | B1 | 6/2001 | Watanabe | |
| 6,273,561 | B1 | 8/2001 | Ahn | |
| 6,332,676 | B1 | 12/2001 | Santhanam | |
| 6,402,306 | B1 | 6/2002 | Childers et al. | |
| 6,474,796 | B1 * | 11/2002 | Ishinaga | 347/85 |
| 6,685,309 | B2 * | 2/2004 | Jones et al. | 347/86 |
| 6,776,479 | B2 | 8/2004 | Ardito et al. | |
| 6,793,330 | B2 * | 9/2004 | Usui et al. | 347/86 |
| 6,899,417 | B1 * | 5/2005 | Shinada et al. | 347/86 |
| 6,969,163 | B2 * | 11/2005 | Studer et al. | 347/86 |
| 7,090,344 | B2 * | 8/2006 | Shinada et al. | 347/86 |
| 7,185,977 | B2 * | 3/2007 | Kyogoku et al. | 347/86 |
| 7,210,772 | B2 * | 5/2007 | Sasaki | 347/86 |
| 2002/0140788 | A1 | 10/2002 | Usui et al. | |
| 2003/0007042 | A1 | 1/2003 | Lu et al. | |
| 2005/0030355 | A1 | 2/2005 | Studer et al. | |
| 2005/0073560 | A1 | 4/2005 | Gray et al. | |

FOREIGN PATENT DOCUMENTS

| | | |
|---|---|---|
| WO | WO 96/04141 | 2/1996 |
| WO | WO96/04141 | 2/1996 |

* cited by examiner

*Primary Examiner*—Stephen D Meier
*Assistant Examiner*—Rene Garcia, Jr.
(74) *Attorney, Agent, or Firm*—Taft, Stettinius & Hollister, LLP

(57) ABSTRACT

An ink cartridge comprising: (a) an ink cartridge body including a floor and an exterior wall partially defining an interior volume, the ink cartridge body including a capillary producing medium; and (b) an ink cartridge cap mounted to the ink cartridge body to substantially enclose the interior volume, the ink cartridge cap including two vents in direct communication with the interior volume, wherein a first vent incorporates an ink supply port. The invention also includes the utilization of a universal ink tank lid for use both in replacement and starter ink tank configurations, as well as methods of utilizing a universal ink tank lid to reduce production costs and complexities.

17 Claims, 2 Drawing Sheets

INK CARTRIDGE VENTING

FIELD OF THE INVENTION

The present invention is directed to inkjet printing and, more specifically, to methods and devices resulting from such methods for venting inkjet ink cartridges. The present invention makes use of multiple vents for an ink cartridge to allow for the flow of gases into or from the ink cartridge.

BACKGROUND AND SUMMARY

The present invention makes use of a universal tank lid fabricated with multiple vents for use in instances when an ink tank is full of ink and when an ink tank is partially filled with ink. More specifically, supply side items such as ink tanks or ink cartridges must be periodically replaced after the inkjet printer deposits a predetermined volume of ink onto a print medium. Ink from these replaceable or refillable cartridges supplies the inkjet nozzles of the printhead so that continued printing is contingent upon a sufficient supply of ink.

Those skilled in the art are well aware that original equipment manufacturers (OEMs) of inkjet printers typically include starter ink tanks. These starter ink tanks are generally not filled to capacity with ink, but do provide the requisite ink to allow the purchaser to operate the printer and become familiar with the operations of the printer. One of the principal operations is the replacement of ink tanks as the ink is consumed. Another operation may include acclimating the purchaser/user with data readouts from the hardware indicating that the tank is low on ink and replacement will be required soon. This gives the purchaser the opportunity to see firsthand how many pages can be printed using a partially empty ink tank.

OEMs that supply replacement ink tanks and other ink tank manufacturers are constantly looking to reduce costs and complexity by making ink tanks and associated ink tank parts interchangeable and adaptable to meet a various operating conditions. As discussed above, one situation may include a starter tank having a substantial volume occupied by gaseous species. Contrast this situation to a replacement ink tank where the overwhelming majority of available volume internally is occupied by capillary producing material and liquid ink. The gaseous species present in starter tanks can be very problematic, especially during shipment. The reason is relatively simple: gases expand and contract much more than solids and liquids when exposed to temperature and pressure changes.

Shipping procedures can include air travel at relatively low pressures and low temperatures. This can cause the gases within the ink tanks to expand by 50% or more. If this degree of expansion were to take place in a fixed volume, the housing holding the gases and liquid ink would be greatly stressed and tend to bow outward to accommodate the expansion of the gases. One way to overcome this potential problem is to fill the ink tank completely full, thereby leaving little to no gaseous volume. A second option, which is encompassed by the instant invention, is to include a second vent allowing gases within the tank to communicate with an environment external to the tank, thereby accommodating for expansion and contraction by substantially maintaining a pressure balance between the interior of the tank and the external environment.

Ink tanks generally include two different configurations. A first configuration includes a single chamber that is occupied by a capillary producing material. A second configuration includes multiple chambers in communication with one another, where the chamber in direct communication with an outlet port includes the capillary producing material. This latter configuration in some circumstances is advantageous over the single chamber configuration because it allows more volume to be occupied by ink, commonly referred to as free ink chambers. Another advantage stems from sensor technology that more easily and accurately detects the amount of ink within a free ink tank than within a ink tank occupied by a capillary producing material.

The instant invention includes ink tanks having multiple chambers such as those having one chamber that is a free ink chamber in communication with a felt chamber that includes a capillary producing material at least partially saturated with liquid ink. The invention adopts a universal ink tank cap that can accommodate replacement situations where both the free ink chamber and the felt chamber are at least substantially full of ink, and a starter ink tank where the free ink chamber is virtually empty and the felt chamber is the primary source of ink to the printhead.

In some embodiments, an ink reservoir is described that comprises (a) a tank body; and (b) a tank cap mounted to the tank body and cooperating with the tank body to define a free ink chamber and a felt chamber for housing a liquid ink therein, the free ink chamber being in direct fluid communication with the felt chamber via an opening in a partition wall, the tank cap including a free ink vent in communication with the free ink chamber, and the tank cap further including a felt chamber vent in communication with the felt chamber.

In some embodiments, at least one of the free ink chamber vent and the felt chamber vent includes an ink fill port. In yet another embodiment, an underside of the ink tank cap includes a furrow adapted to receive the partition wall of the tank body. In a further embodiment, at least one of the free ink vent and the felt chamber vent includes a labyrinth duct having a length to width ratio of 25:1 or larger. In still another embodiment, the felt chamber includes a capillary producing medium for dispensing liquid ink from the felt chamber. In another embodiment, the free ink chamber is substantially free of a capillary producing medium. In yet another embodiment, a stop is included to inhibit direct communication between the free ink chamber and an external environment.

In still another embodiment, the felt chamber vent includes a felt chamber groove formed within the ink cap. In another embodiment, the free ink chamber vent includes a free ink chamber groove formed within the ink cap. In a further detailed embodiment, the tank cap includes a felt chamber vent through hole and a free ink chamber vent through hole. In still a further detailed embodiment, the tank cap further includes a covering substantially overlaying the felt chamber groove, the free ink chamber groove, the felt chamber vent through hole, and the free ink chamber vent through hole. In a another embodiment, the covering cooperates with the felt chamber groove to form a felt chamber duct with one end open to the felt chamber through hole and an opposing end open to an external environment. In another embodiment, the covering cooperates with the free ink chamber groove to form a free ink chamber duct with one end open to the free ink chamber through hole and an opposing end open to the external environment.

In accordance with other embodiments, an ink cartridge cap is described that includes a substrate for mounting to an ink cartridge body to provide a substantially enclosed ink cartridge, the substrate including a first vent and a second vent providing fluid communication between a proximal side of the ink cartridge cap and a distal side of the ink cartridge cap, where the proximal side is intended to comprise an interior surface of an inkjet cartridge and the distal side is intended to comprise an exterior surface exposed to an external environment when mounted to the ink cartridge body, and where the second vent includes an ink fill port in communication with a labyrinth duct.

In another embodiment, the first vent includes an extended duct having a length to width ratio of 25:1 or larger, and the labyrinth duct includes a length to width ratio of 25:1 or larger, and the ink fill port has a diameter larger than a width of the labyrinth duct. In yet another more detailed embodiment, the invention further includes a covering overlaying a first groove within the substrate to form the extended duct, the extended duct and a first through hole forming a first extended channel that provides direct gaseous communication between proximal and distal sides of the substrate, the covering also overlaying a second groove within the substrate to form the labyrinth duct, the labyrinth duct and ink fill hole forming a second extended channel that provides direct gaseous communication between proximal and distal sides of the substrate.

In other embodiments, an ink cartridge is described that includes (a) an ink cartridge body including a floor and an exterior wall partially defining an interior volume, the ink cartridge body including a capillary producing medium; and (b) an ink cartridge cap mounted to the ink cartridge body to substantially enclose the interior volume, the ink cartridge cap including two vents in direct communication with the interior volume, wherein a first vent incorporates an ink supply port In some embodiments, a method of venting a multi-chamber ink cartridge is described that includes the steps of (a) forming a first vent passage and a second vent passage in an ink cartridge lid; (b) mounting the ink cartridge lid to an ink cartridge body to form a multi-chamber ink cartridge having an interior ink supply region and an overflow region, the ink supply region including a capillary producing medium substantially occupying the ink supply region and in communication with the overflow region; (c) venting the ink supply region to an external environment using the first vent passage; and (d) orienting the second vent passage between the overflow region and the external environment.

In some embodiments, the method includes stopping the second vent passage to discontinue communication between the external environment and the free ink chamber. In still other embodiments, the method includes unstopping the second vent passage to allow communication between the external environment and the free ink chamber.

In some embodiments, a method of filling an ink reservoir with ink is described that includes (a) dispensing a predetermined volume of ink into an interior volume of an ink reservoir and into communication with a capillary producing material substantially occupying a supply chamber of the ink reservoir, the ink reservoir also including a reserve chamber in direct communication with the supply chamber; and (b) incorporating two vents into the ink reservoir, the first vent establishing a first vent passage between an external environment and the supply chamber, and the second vent establishing a second vent passage between the external environment and the reserve chamber.

In some embodiments, the method includes stopping the second vent when the predetermined volume of ink dispensed in the dispensing act is sufficient to substantially fill the supply chamber and the reserve chamber.

In some embodiments, a method of fabricating and filling ink cartridges is described that includes (a) fabricating a first ink cartridge using a first cartridge cap and a first cartridge body, the first ink cartridge including an interior volume, the first ink cartridge including a plurality of vents providing communication between the interior volume and an external environment; (b) dispensing a predetermined amount of ink into the interior volume of the first ink cartridge; (c) stopping at least one of the plurality of vents of the first ink cartridge; (d) fabricating a second ink cartridge using the first cartridge cap and a second cartridge body, the second ink cartridge including an interior volume, the second ink cartridge including a plurality of vents providing communication between the interior volume and the external environment; (e) dispensing a predetermined amount of ink into the interior volume of the second ink cartridge, where a percentage of the interior volume of the first ink cartridge occupied by liquid ink is greater than a percentage of the interior volume of the second ink cartridge In some embodiments, the first ink cartridge includes two ink chambers in communication with one another, the second ink cartridge includes two ink chambers in communication with one another, the first cartridge cap includes a plurality of through holes, with at least two of the through holes in communication with a labyrinth duct, and each through hole in communication with a labyrinth duct comprises a vent.

DETAILED DESCRIPTION

The exemplary embodiments of the present invention are described and illustrated below to encompass methods and devices resulting from such methods for venting the contents of a disposable ink tank. In addition, the exemplary embodiments utilize interchangeable parts such as interchangeable ink tank lids for starter and replacement ink tanks not before recognized, disclosed, or utilized. Of course, it will be apparent to those of ordinary skill in the art that the preferred embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present invention.

Figure 1:
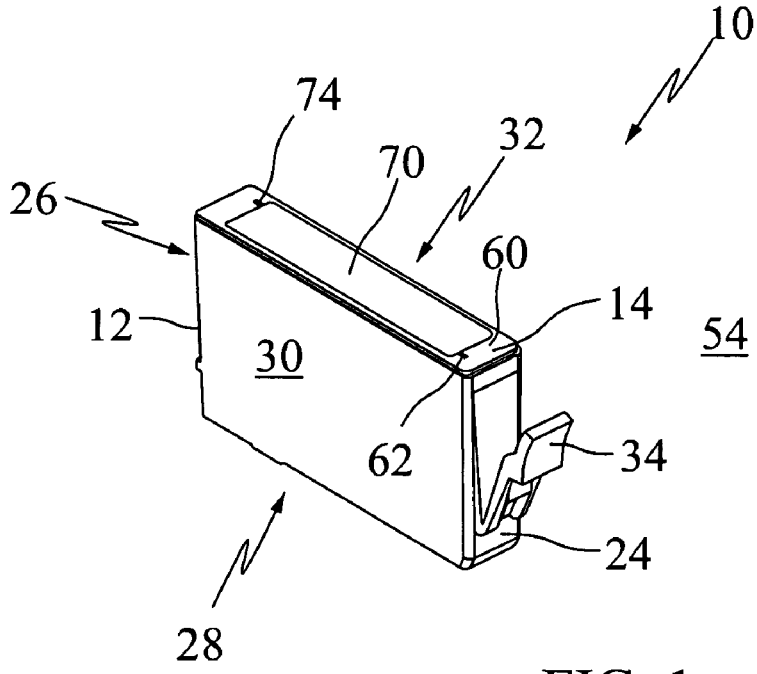
FIG. 1 is an elevated perspective view of an exemplary ink tank in accordance with an embodiment of the present invention.
Figure 2:
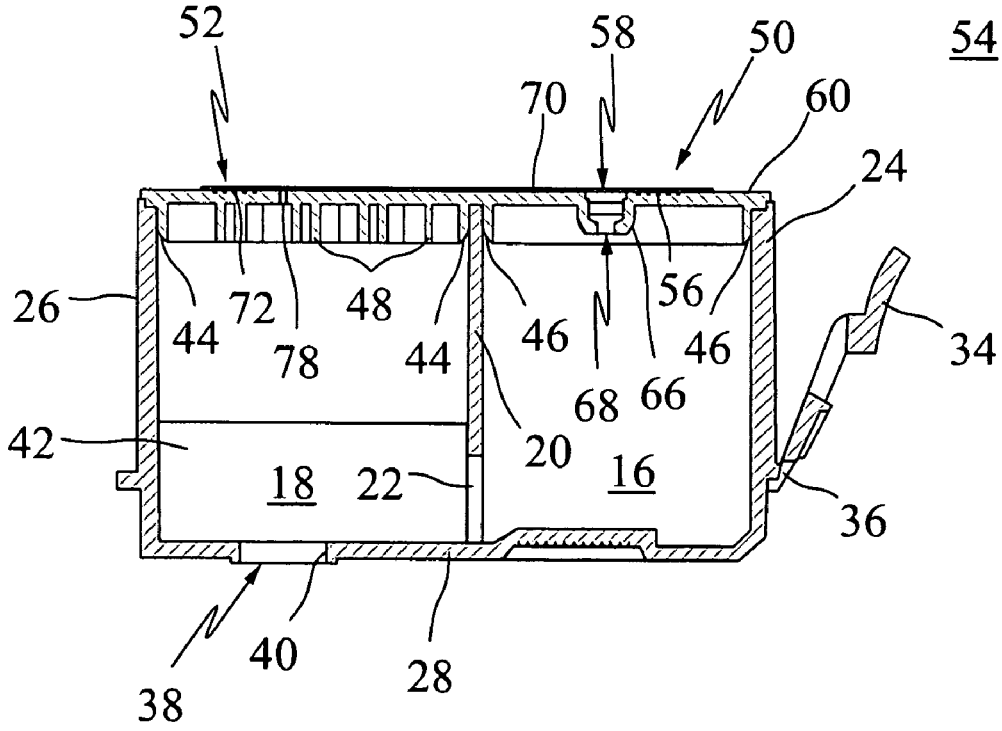
FIG. 2 is a cross-sectional view of the exemplary ink tank of FIG. 1.

Referencing FIGS. 1 and 2, an exemplary disposable ink tank 10 includes a hollowed out body 12 that receives a lid 14 to define an interior region comprising a free ink chamber 16 and a felt chamber 18. A partition wall 20 within the ink tank 10 divides the chambers 16, 18 from one another; however, a passage 22 within a lower portion of the partition wall 20 allows fluid communication between the chambers 16, 18.

The body 12 includes opposing front and rear walls 24, 26 that are connected to one another by a bottom wall 28 and opposing vertical sidewalls 30, 32. The front wall 24 includes an integrated latch 34, that is biased by a living hinge 36, for mounting the tank 10 to an on-carrier or off-carrier docking station (not shown) of an inkjet printer.

An ink conduit 40 extends through the bottom wall 28 to provide a path along which ink flows between a polypropylene felt material 42 within the felt chamber 18 and a wick (not shown) of the docking station. An opening 38 within the conduit 40 may be sealed with a, removable, polymer sheath (not shown) to inhibit ink from exiting the chamber 18 prior to the wick of the docking station being received within the conduit 40 so that ink within the felt 42 is in fluid communication with a plurality of nozzles of an inkjet printhead (not shown).

Figure 3:
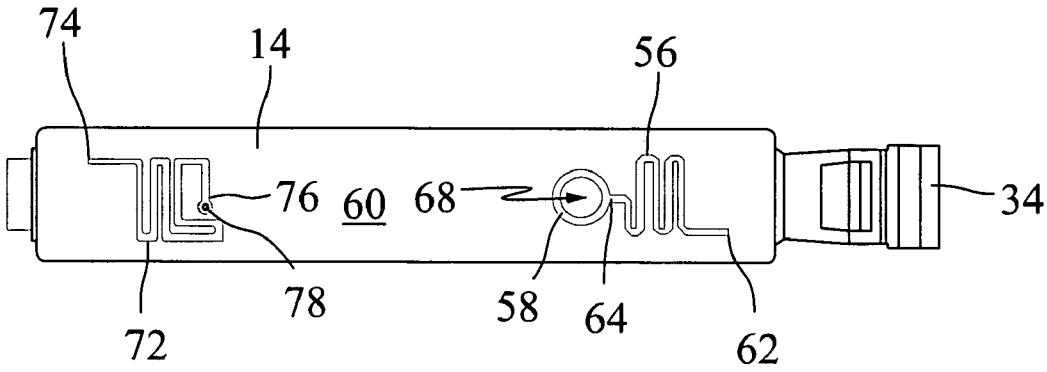
FIG. 3 is a top view of the exemplary ink tank of FIG. 1, without a label.

Referring to FIGS. 2 and 3, the underside of the lid 14 includes two rectangular projections 44, 46 that are received within corresponding rectangular openings on top of the body 12 corresponding to the cross-sectional areas of the free ink chamber 16 and the felt chamber 18. The first rectangular projection 44 includes a series of ribs 48 that traverse between the opposing vertical sidewalls 30, 32 to increase the rigidity of the lid 14, which is compromised by the presence of venting structures 50, 52 for each chamber 16, 18.

The free ink chamber vent 50 includes a serpentine trench 56 in communication with an ink fill port 58. The trench 56 is formed within the top surface 60 of the lid 14 and includes a far end 62, and a near end 64 that intersects with the fill port 58. The fill port 58 includes a recessed bowl 66 having an orifice 68 at the base of the bowl for communicating directly with the interior of the free ink chamber 16. A label 70 is adhered to the top surface 60 of the lid 14 to cover the fill port 58 and a majority of the trench 56, while leaving exposed the far end 62. The trench 56 and label 70 cooperate to define a narrow duct 56 through which gases or liquid can flow. In this manner, the fill port 58, trench 56, and label 70 cooperate to provide the vent structure 50 linking the interior of the free ink chamber 16 with the external environment 54.

The felt chamber vent 52 includes its own serpentine trench 72 formed within the top surface 60 of the lid 14. The trench 72 includes a far end 74, and a near end 76 that intersects with a passage 78 extending through the lid 14. A label 70, the same label used for the free ink chamber vent 50, or a different label, is adhered to the top surface 60 of the lid 14 to cover the passage 78 and a majority of the trench 72, while leaving exposed the far end 74. In this manner, the passage 78, trench 72, and label 70 cooperate to provide a vent structure 52 linking the interior of the felt chamber 16 with the external environment 54.

In operation, the tank 10 may be adapted for use as a starter ink tank, in which case the free ink chamber is substantially empty, or the tank 10 may be adapted for use as a replacement ink tank, in which case the free ink chamber is substantially full of ink. In either instance, capillary action propels the ink through the wick material 42. Capillary action pulls the ink through the wick material 42 only when ink is consumed by the printhead. Most commonly, the consumption of ink by the printhead draws ink from the wick of a docking station (not shown), which when physically touching the capillary producing material 42 in the outlet conduit 40, and creates a fluid bridge that pulls ink from the capillary producing material 42 within the bulk felt chamber 18. As the level of ink within the capillary producing material 42 of the felt chamber 18 drops below the passage between the chambers 16, 18, gases within the felt chamber 18 travel into the free ink chamber 16 and are replaced by liquid ink, presuming liquid ink is present in the free ink chamber 16. Therefore, the separation between the chambers 16, 18 is important so that the capillary producing material 42 does not become oversaturated. Capillary producing material 42 that is oversaturated becomes susceptible to gravitational forces that can draw the ink from the capillary producing material 42 at a faster rate than what the printhead can accommodate, resulting in weeping of the printhead.

Referring to FIG. 2, the disposable ink tank 10 can be partially filled (starter ink tank configuration) or completely filled with ink (replacement ink tank configuration). In addition, the filling process may be carried out in one or more distinct steps, depending upon the intended application. For instance, original equipment manufacturers of printer equipment generally include disposable ink tanks (starter ink tanks) along with the printer hardware. When the consumer unpacks the printer hardware (i.e., an inkjet printer), the user will likely desire to operate the printer immediately, which will require the installation of ink reservoirs/tanks, such as the disposable ink tank 10 of the present invention. While the partial filled character of these starter tanks provide some advantages, these tanks also provide some concerns.

One concern is the effect that environmental conditions will have on the gaseous contents of the ink tank. For instance, if the tank starter cartridge free ink chamber is sealed at room temperature and atmospheric pressure, with an appreciable volume of the tank being occupied by a gas, later exposure to a different temperature or pressure will drastically change the gas volume within the tank and force ink out of the felt chamber vent.

In contrast, suppliers of replacement ink tanks find it advantageous to utilize substantially the entire volume to accommodate the capillary producing material and the liquid ink. Generally, replacement ink tanks have more than 90% of the available interior volume being occupied by the capillary producing material and liquid ink. The relatively small volume occupied by gases decreases the potential for tank failure when the tank is exposed to significantly different temperatures or pressures because the volume of a liquid changes only slightly with pressure and temperature.

The instant disposable ink tank 10 may be utilized as a starter ink tank or as a replacement ink tank, based in part upon the features fabricated into the lid 14. When used as a starter ink tank, the felt chamber 18 is partially or fully filled with liquid ink sufficient to fill the wick material 42 occupying substantially the entire chamber 18. To fill the wick material 42, ink may be filled in the opening within the felt chamber 18 when the lid 14 is absent, or may be added subsequent to the lid being adhered to and sealed to the ink tank body 12. Introducing ink into the felt chamber 18 subsequent to the lid 14 being mounted to the ink tank body 16 can be accomplished through the ink fill port 58 or through the ink conduit 40. When introducing ink into capillary producing material 42, gases within the capillary producing material 42 are displaced and may be vented through one or both of the vents 50, 52, as well as through the conduit 40 itself. As the gases are displaced, the level of ink within the capillary producing material 42 increases until substantially all of the capillary producing material is filled. Further introduction of ink into the capillary producing material 42 will force ink out the felt vent 52, through the conduit 40, or backup in to the free ink chamber 16. While this backup may be acceptable in a replacement ink tank configuration, it is not preferred in a starter ink tank configuration. Continued filling of ink will eventually lead to the saturation of the capillary producing material 42, thereby filling the felt chamber 18, as well as filling of the free ink chamber 16.

The resulting ink tank 10 includes a felt chamber 18 substantially filled with capillary producing material 42 filled with ink in a starter ink tank configuration, and also includes the free ink chamber being substantially filled with liquid ink in the replacement ink tank configuration. As discussed previously, liquid and gaseous transfer may occur between the chambers 16, 18 by way of passage 22, however, if the level of ink within the capillary producing material 42 is not below the level of the passage 22, no gaseous communication can occur. Thus, gaseous expansion within each chamber 16, 18 is accommodated by the respective vents 50, 52.

Figure 4:
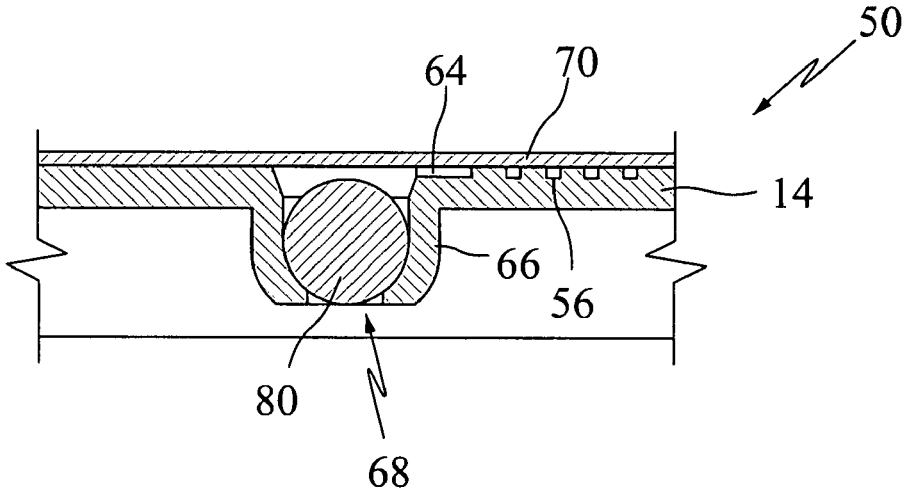
FIG. 4 is a magnified cross-sectional view of a first exemplary vent of the ink tank of FIG. 1.

Referring to FIG. 4, an exemplary free ink vent 50 is shown in a replacement ink tank configuration. In this configuration, the free ink chamber 16 is substantially filled with liquid ink so that the level of ink approximates the orifice 68 in the recessed bowl 66. After ink has filled the free ink chamber 16, a fill ball 80 is introduced into the interior of the recessed bowl 66 of the fill port 58 to plug the orifice 68, thereby inhibiting liquid ink from passing into the free ink vent 50. However, the fill ball 80 also blocks gases from exiting or entering the free ink chamber 16 through the free ink vent 50, therefore it is important that the area occupied by gaseous species is reasonably small. A label 70 is applied over the trench 56 after the fill ball 80 has been inserted into the fill port 58, but may be applied leaving some, none, or the entire trench 56 and/or fill port 58 exposed.

It is also within the scope of the invention to have a replacement tank configuration where a fill ball 80 is not utilized. In such an embodiment, the label 70 that covers the trench 56 and fill port 58 is extended to cover the far end 62 of the trench 56, sealing off the entire vent 50 from the external environment 54.

Figure 5:
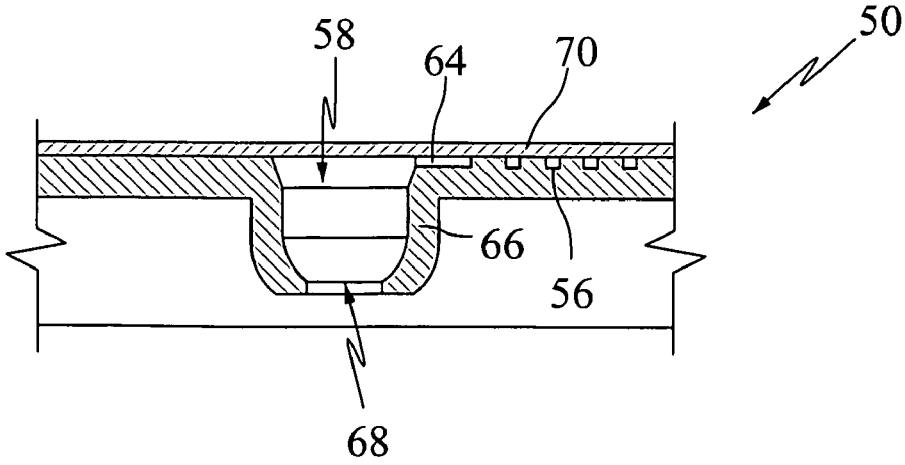
FIG. 5 is a magnified cross-sectional view of a second exemplary vent of the ink tank of FIG. 1.

Referencing FIG. 5, an exemplary free ink vent 50 is shown in a starter ink tank configuration. In this configuration, the free ink chamber 16 is empty or includes a minimal amount of liquid ink so that the level of ink does not approximate the orifice 68 in the recessed bowl 66. A label 70 is applied over the fill port 58 and over a majority of the trench 56 to leave exposed the far end 62 of the trench 56. In this manner, gases can enter or exit from the free ink chamber 16. Gases exiting from the free ink chamber 16 pass through the orifice 68 and into the fill port 58, and thereafter flow into the near end 64 of the duct 56. The gases flow through the duct 56 and communicate with the external environment 54 via the exit point at the far end 62 of the duct.

The trench/duct 56 of the present invention preferably includes a width substantially smaller than the overall length. Exemplary length-to-width ratios range from 10:1 to 200:1. While the exemplary trench 56 has been described in a serpentine path, it is also within the scope of the invention that other path configurations be utilized so long as the length-to-width ratio is maintained. Additional exemplary trench paths include spiral paths and incremental increasing rectangular paths.

It is also within the scope of the invention to provide more than two vents 50, 52 in the lid 14. Such an alternate configuration may include two free ink vents 50 and two felt chamber vents 52.

It is further within the scope of the invention to utilize ink tank bodies having dimensions other than those shown and discussed. For example, the ink tank configuration may includes a felt chamber 18 that is larger than the free ink chamber 16, or a configuration may include a free ink chamber 16 that is larger than the felt chamber 18.

The flexibility of some embodiments of the present invention derives in part from using a lid 14 fabricated with multiple vents 50, 52, where one or more of the vents can be shut off to accommodate particular use ink cartridges. In this manner, production costs and complexities are reduced by using a single lid for multiple ink cartridge bodies.

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. An ink reservoir comprising:

a tank body; and a tank cap mounted to the tank body and cooperating with the tank body to define a free ink chamber and a felt chamber for housing a liquid ink therein, the free ink chamber being in direct fluid communication with the felt chamber via an opening in a partition wall, the tank cap including a free ink vent in communication with the free ink chamber, and the tank cap further including a felt chamber vent in communication with the felt chamber.

2. The ink reservoir of claim 1, wherein at least one of the free ink chamber vent and the felt chamber vent includes an ink fill port.

3. The ink reservoir of claim 1, wherein an underside of the ink tank cap includes a furrow adapted to receive the partition wall of the tank body.

4. The ink reservoir of claim 1, wherein at least one of the free ink vent and the felt chamber vent includes a labyrinth duct having a length to width ratio of 25:1 or larger.

5. The ink reservoir of claim 1, wherein the felt chamber includes a capillary producing medium for dispensing liquid ink from the felt chamber.

6. The ink reservoir of claim 1, wherein the free ink chamber is substantially free of a capillary producing medium.

7. The ink reservoir of claim 1, wherein:

the felt chamber vent includes a felt chamber groove formed within the ink cap;

the free ink chamber vent includes a free ink chamber groove formed within the ink cap;

the tank cap includes a felt chamber vent through hole and a free ink chamber vent through hole; and the tank cap further includes a covering substantially overlaying the felt chamber groove, the free ink chamber groove, the felt chamber vent through hole, and the free ink chamber vent through hole;

wherein the covering cooperates with the felt chamber groove to form a felt chamber duct with one end open to the felt chamber through hole and an opposing end open to an external environment; and wherein the covering cooperates with the free ink chamber groove to form a free ink chamber duct with one end open to the free ink chamber through hole and an opposing end open to the external environment.

8. The ink reservoir of claim 1, further comprising a stop to inhibit direct communication between the free ink chamber and an external environment.

9. An ink cartridge cap comprising a substrate for mounting to an ink cartridge body to provide a substantially enclosed ink cartridge, the substrate including a first vent and a second vent providing fluid communication between a proximal side of the ink cartridge cap and a distal side of the ink cartridge cap, where the proximal side is intended to comprise an interior surface of an inkjet cartridge and the distal side is intended to comprise an exterior surface exposed to an external environment when mounted to the ink cartridge body, and where the second vent includes an ink fill port in communication with a labyrinth duct.

10. The ink cartridge cap of claim 9, wherein:

the first vent includes an extended duct having a length to width ratio of 25:1 or larger; and the labyrinth duct includes a length to width ratio of 25:1 or larger, and the ink fill port has a diameter larger than a width of the labyrinth duct.

11. The ink cartridge cap of claim 9, further comprising a covering overlaying a first groove within the substrate to form the extended duct, the extended duct and a first through hole forming a first extended channel that provides direct gaseous communication between proximal and distal sides of the substrate, the covering also overlaying a second groove within the substrate to form the labyrinth duct, the labyrinth duct and ink fill hole forming a second extended channel that provides direct gaseous communication between proximal and distal sides of the substrate.

12. An ink cartridge comprising:

an ink cartridge body including a floor and an exterior wall partially defining an interior volume, the ink cartridge body including a capillary producing medium; and an ink cartridge cap mounted to the ink cartridge body to substantially enclose the interior volume, the ink cartridge cap including two vents in direct communication with the interior volume, wherein a first vent incorporates an ink supply port.

13. A method of venting a multi-chamber ink cartridge comprising:

forming a first vent passage and a second vent passage in an ink cartridge lid;

mounting the ink cartridge lid to an ink cartridge body to form a multi-chamber ink cartridge having an interior ink supply region and an overflow region, the ink supply region including a capillary producing medium substantially occupying the ink supply region and in communication with the overflow region;

venting the ink supply region to an external environment using the first vent passage; and orienting the second vent passage between the overflow region and the external environment.

14. The method of claim 13, further comprising the act of stopping the second vent passage to discontinue communication between the external environment and the overflow region.

15. The method of claim 14, further comprising the act of unstopping the second vent passage to allow communication between the external environment and the overflow region.

16. A method of filling an ink reservoir with ink, the method comprising:

dispensing a predetermined volume of ink into an interior volume of an ink reservoir and into communication with a capillary producing material substantially occupying a supply chamber of the ink reservoir, the ink reservoir also including a reserve chamber in direct communication with the supply chamber; and incorporating two vents into the ink reservoir, the first vent establishing a first vent passage between an external environment and the supply chamber, and the second vent establishing a second vent passage between the external environment and the reserve chamber.

17. The method of claim 16, further comprising the act of stopping the second vent when the predetermined volume of ink dispensed in the dispensing act is sufficient to substantially fill the supply chamber and the reserve chamber.

* * * * *